US006282937B1

(12) United States Patent
Michaud

(10) Patent No.: US 6,282,937 B1
(45) Date of Patent: Sep. 4, 2001

(54) CORNER BEAD RE-SHAPING TOOL

(75) Inventor: Robert Michaud, Old Saybrook, CT (US)

(73) Assignee: Bead Master Company LLC, Old Saybrook, CT (US)

( * ) Notice: Subject to any disclaimer, the term of this patent is extended or adjusted under 35 U.S.C. 154(b) by 0 days.

(21) Appl. No.: 09/528,347

(22) Filed: Mar. 17, 2000

(51) Int. Cl.[7] ..... B21D 5/08

(52) U.S. Cl. ..... 72/178; 72/176; 72/182; 72/379.2

(58) Field of Search ..... 72/176, 178, 182, 72/379.2, 211; 29/560, 560.1; 280/727

(56) References Cited

U.S. PATENT DOCUMENTS

| | | | | |
|---|---|---|---|---|
| 420,576 | * | 2/1890 | Heesom | 72/176 |
| 526,714 | * | 10/1894 | Kirby | 72/176 |
| 1,880,246 | * | 10/1932 | Greiner | 72/179 |
| 2,159,290 | * | 5/1939 | Penkala | 72/179 |
| 2,191,390 | | 2/1940 | Hooper | 80/35 |
| 3,333,451 | | 8/1967 | Inlow | 72/179 |
| 3,344,641 | | 10/1967 | Pomory | 72/177 |
| 3,355,922 | | 12/1967 | Utashiro | 72/178 |
| 3,430,475 | | 3/1969 | Lindmark | 72/179 |
| 4,145,905 | | 3/1979 | Mattie | 72/177 |
| 4,848,126 | * | 7/1989 | Fryfogle | 72/379.2 |
| 5,067,338 | | 11/1991 | Wilchynski | 72/182 |
| 5,253,913 | * | 10/1993 | Metivier | 296/37.6 |
| 5,311,760 | * | 5/1994 | Thompson | 72/176 |
| 5,515,706 | * | 5/1996 | Paul | 72/379.2 |
| 5,560,666 | * | 10/1996 | Vieira | 296/3 |
| 5,974,849 | * | 11/1999 | Dixon | 72/179 |

FOREIGN PATENT DOCUMENTS 1262022 10/1989 (JP) .

* cited by examiner

*Primary Examiner*—Daniel C. Crane
(74) *Attorney, Agent, or Firm*—C. G. Nessler

(57) ABSTRACT

A tool for reshaping corner bead, which is perforated right angle metal strip used in fabrication of corners in drywall building construction, spreads the legs of 90 degree angle corner bead outwardly to increase the included angle thereof. The bead is rolled between a pressure roller and a multiplicity of idler rollers. The apex of the bead runs in a circumferential groove of the vertically adjustable pressure roller which presses downwardly as the legs ride upon idler rollers which resist the downward force while allowing sideward motion of the legs. Preferably, the rollers are comprised of mated pairs of hemispheres and the bead is made to pass through the tool by driving the pressure roller with a screw gun. The frame of the tool has a detachable tang which enables the tool to be mounted from the side wall pocket of a common pickup truck box.

15 Claims, 4 Drawing Sheets

CORNER BEAD RE-SHAPING TOOL

TECHNICAL FIELD

The present invention relates to metal forming tools, in particular, to tools for forming metal corner beads, or perforated angle iron strips used in connection with wallboard or drywall paneling.

BACKGROUND

Sheet Rock®, also called wallboard, drywall, plasterboard and gypsum board, is manufactured panel used for rapid and efficient construction of interior walls of buildings. A typical wallboard panel comprises a pressed gypsum (calcium sulfate) board sandwiched between sheets of smooth, strong cardboard and paper. When wallboard is applied to walls, metal corner beads are often used for quickly and easily constructing outside corners. A familiar commercial corner bead product comprises a length of light gage angle iron strip which is bent to a 90 degree included angle. When making a typical right angle wallboard wall outside corner, the wallboard mechanic nails or screws the corner bead over the corner joint which formed by two intersecting pieces of wallboard, previously fastened to the wall. Then, the mechanic applies one or more layers of a thick aqueous paste of gypsum or other ceramic powder, commonly called joint compound, over the corner bead and adjacent wallboard. The resultant corner has good definition and appearance, and good provides resistance to damage when objects hit the corner during use of the building.

Manufactures of corner beads typically supply them with a 90 degree included angle, since that is the angle of most corners meet in buildings. However, when there is a corner in a building wall having an included angle greater than 90 degrees, for instance 135 degrees, the wallboard finisher will either forgo the use of a corner bead or re-shape a 90 degree angle bead. Since it is preferable to have some sort of corner bead, the typical approach is to re-shape a common 90degree angle bead. Mechanics typically accomplish such by lying the bead on a flat surface, such as a floor or table, so its legs are facing upward and the apex is down on the surface. Then, by lightly hammering along the length of the bead, the legs are spread, or splayed apart. Doing this takes time and can result in an imperfect or uneven job. Even a skilled mechanic might deform the corner bead more or less than the desired amount; or might vary the degree of splaying along the length of the bead. Because the legs of a corner bead are perforated, the corner bead has an uneven stiffness from point to point along its length. That distinguishes it from a common piece of angle iron strip and makes the deformation of the legs less uniform and predictable.

Of course, factories are capable of manufacturing corner beads with other-than-90 degree included angles and some about-133 degree angle beads are commercially available. But, a variety of such beads is not commonly available. And, because non-90 degree angle corner beads are used relatively infrequently, mechanics will avoid stocking such items. Thus, there is a need for a way to quickly, easily and accurately alter the dimension of conventional 90 degree angle corner bead in the field, using a tool which is convenient and reasonable in cost

SUMMARY

An object of the invention is to provide a convenient and economic means for re-shaping corner beads in the field. Another object of the invention is to reform 90 degree metal corner beads so that they are evenly changed to the new angle along their length.

In accord with the invention a tool for re-shaping corner bead used in wallboard installation, so the included angle between the legs of the bead is increased, is comprised of a frame; at least one idler roller mounted on the flame; a pressure roller mounted from the frame vertically above the idler roller, and means for controlling the transverse location of the corner bead as it is acted on by the combination of pressure roller and idler roller. The legs of the corner bead roller on the idler roller while the pressure roller presses on the apex of the corner bead, to thereby deform it. The idler rollers are configured to enable the lateral or splaying motion of the legs of the corner bead.

DESCRIPTION

Figure 1:
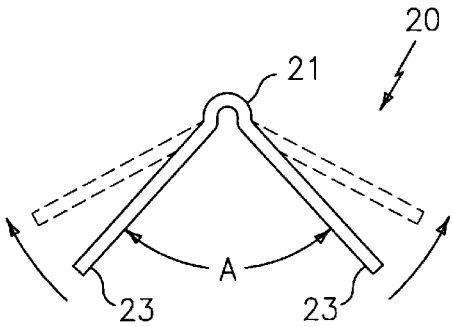
FIG. 1 shows an end view of a 90 angle corner bead.

A corner bead 20, for use with wallboard panels and the like, is shown in end view in FIG. 1. The component is also referred to as a "bead" and as an "angle". The typical bead is an right angle strip made of light gage sheet metal or other permanently deformable material, typically in 6'–10" or greater lengths. The invention will be understood to apply to the re-shaping of corner beads made of other permanently deformable materials, such as plastics. The commercial bead 20 has an apex 21 which is rounded and is opposing side legs 23, running at as-manufactured angle A of 90 degrees. The phantom corner bead in the Figure illustrates the desired way in which legs 23 will be splayed, so angle A is increased, through use of the invention.

Figure 3:
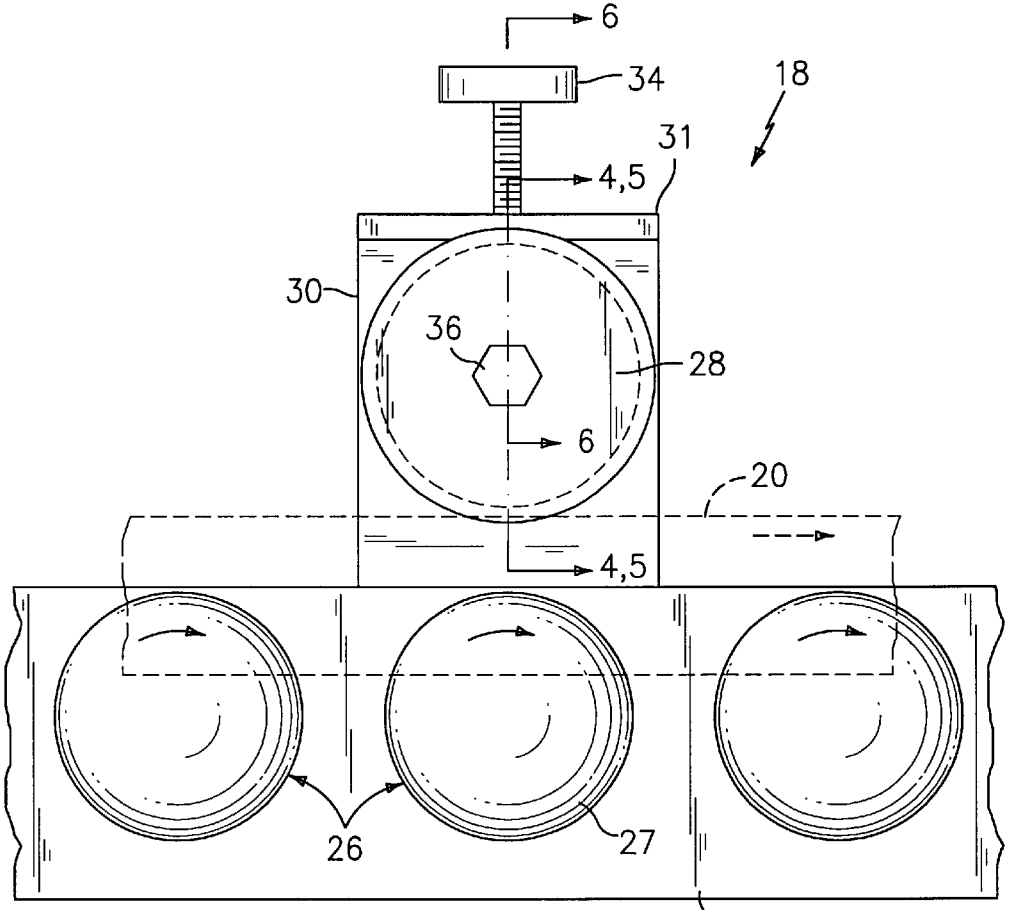
FIG. 3 is a side elevation view of the device shown in FIG. 2.
Figure 2:
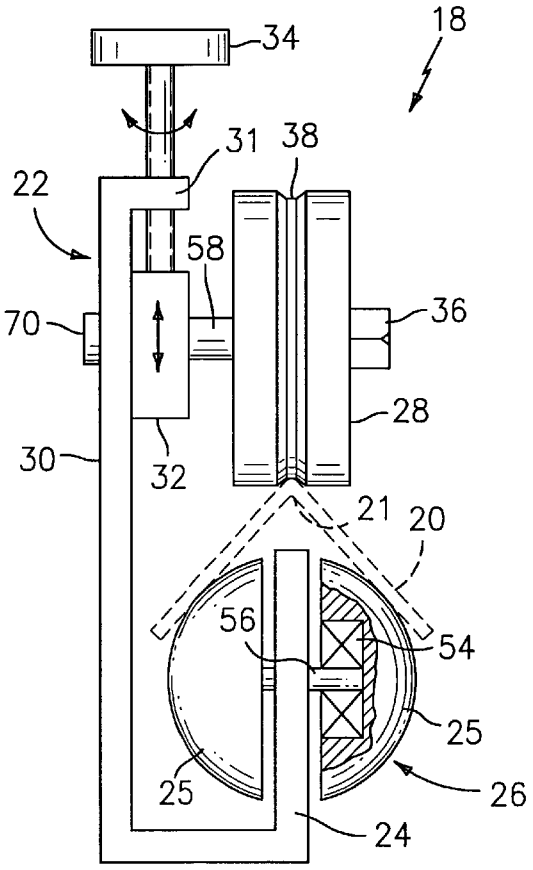
FIG. 2 is an end elevation view of a preferred embodiment tool of the invention.

The side and end elevation views of FIG. 2 and FIG. 3 show a preferred embodiment of tool 18, referred to here more particularly as a bead re-shaper tool. Tool 18 is comprised of a frame 22 which has a lengthwise horizontal plate or rail 24. The rail 24 supports five pairs of spaced apart hemispherical half-rollers 25. Each mating pair of half-rollers 25 functionally comprises a roller 26. As described below rollers 26, which are referred to as idler rollers, may have other configurations. The idler rollers 26 are mounted on stub shafts 56 which are screwed or pressed into transverse holes in the rail 24. Preferably the bodies and working surfaces of the rollers are made of molded plastic. Captured within each body of a half-roller 25 is a oil impregnated sleeve bearing 54. Each half-roller rotates independently on its own stub shaft 56. However, the opposing half-rollers of a given pair may be mounted off a single rotatable shaft so they move together. A mated pair of roller hemispheres may be envisioned as create an imaginary sphere, or in end-view, a circle. See FIG. 2. The series of spaced apart rollers dictate that any angle strip which is laid thereon with legs down will run along a straight path having a desired bearing, or direction Spaced apart from rail 26, and running vertically upward parallel to the rail, is a vertical arm or stanchion 30 which terminates in a horizontal stub arm 31. A pressure roller 28 is mounted from the stanchion by means of a vertical adjustment assembly, so the pressure roller can be changed in elevation relative to the elevation of the idler rollers. A v-shape groove 38 runs around the circumferential periphery of roller 28. The plane of the center of groove 38 of roller 28 lies coincides with the vertical plane of the centerline of the several of idler rollers and the aforementioned straight path of the corner bead which is dictated by the rollers. The groove 38 is shaped to receive the exterior of the apex 21 of a corner bead 20, when it passes through the tool. See FIG. 2 and the phantom end view of the bead 20.

Figure 4:
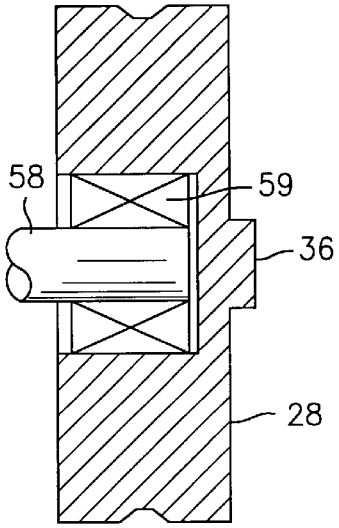
FIG. 4. is a vertical plane cross section showing how the pressure roller of the tool in FIG. 2 is constructed, so it may be driven by a motorized hand tool.

The cross section view of FIG. 4 shows one type of internal construction of pressure roller 28 and associated components. With reference to FIG. 2 and FIG. 4, roller 28 rotates on stub shaft 58 by means of internal ball bearing assembly 59. The stub shaft 58 cantilevers from slide block 32.

The FIG. 4 roller has an integral hexagonal stub shaft 36 extending from the center of its outer diametrical face. Thus, roller 28 may be driven when shaft 36 is engaged by a socket which is driven by an electric screw gun or hand crank. A permanently attached hand crank may alternatively be attached to roller 28. Other known disengage able and permanently attached driving means variations may be employed.

Figure 5:
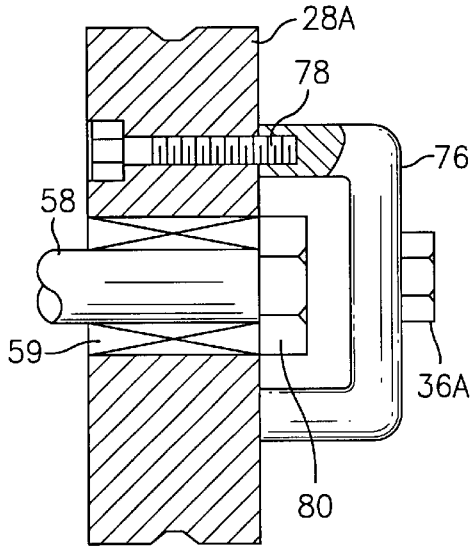
FIG. 5 is a view like FIG. 4 showing an altemative construction.

The partial cross section of FIG. 5 shows altemrate embodiment pressure roller 28A which is fastened to stub shaft 58 by nut 80. U-shape bracket 76 is fned to the outer diametrical face of the roller by cap screws 78. A hexagonal stub shaft 36A enables the bracket and thus the roller to be rotated by means of an motor-driven socket. Obviously, a female pocket may be provided in place of the male shaft. Thus, in the generality of this aspect of the invention, the pressure roller has a receptor for a driver, to enable rotation of the roller. Even more generally, other means may be employed to drive the pressure roller. For example, the roller may be fixedly mounted to the shaft, the shaft may be rotatably mounted in the slide block, and the shaft may be driven by a variety of known means. However, such variations would appear to disadvantageously increase weight and cost for the hand tool embodiment of the invention.

Figure 6:
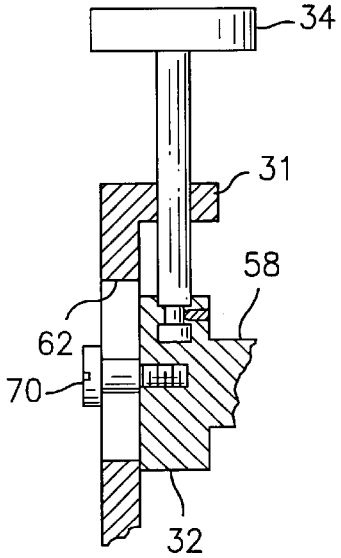
FIG. 6 is a vertical plane cross section of a portion of the top of the stanchion part of the tool of FIG. 2, showing how the pressure wheel position is vertical adjusted

The elevation cross section of FIG. 6 shows the construction of the vertical adjustment assembly for pressure roller 28 which is mounted on shaft 58. Shaft 58 is an integral part of the slide block 32 which is slidably engaged with the stanchion 30 by means of shoulder screw 70 which passes through a vertical slot 62 in the stanchion. An adjusting screw 34 is threaded through the stub arm 31 of the stanchion and captured within the slide block in a manner which permits free rotation of the screw relative to the block. Thus block 32 and the roller move up and down when the adjusting screw 34 is turned, and that changes the spacing between the groove roller 28 and the horizontal plane of the hemispherical rollers. Other mea=s for supporting and vertically adjusting the position of the pressure roller will be within the ordinary skill.

FIGS. 2 and 3 show in phantom how a corner bead passes through the tool 18, for re-shaping. In use, the legs of the corner bead 20 ride along the spaced apart tops of the hemispheric idler rollers 26 and the bead apex 21 fits into the groove 38 of the roller 28. The vertical spacing between the grooved roller and the idler rollers is such that, when the corner bead (or any other angle strip) is passed through the tool, it is deformed. Decreasing the vertical spacing increases the degree to which the corner bead is splayed, and the amount to which the corner bead angle A is opened up.

The corner bead may be either pushed or pulled manually through the device. Preferably, the roller 28 is rotated manually or by a motor/driver, as indicated by the arrow on the roller in FIG. 3. When roller 28 is rotated, that will move any the corner bead being altered lengthwise, causing rotation of rollers 26 by frictional engagement with the corner bead, again as indicated by arrows thereon in FIG. 3.

For convenience, the roller 28 is called the pressure roller and the rollers 26 are called idler rollers. However, it will be understood that both pressure roller and idler rollers equally exert force on the strip. Also, it will be evident that the one or more of the idler rollers, particularly the idler roller 27, or the proximate up and downstream or rollers which straddle the location of the pressure roller, may be driven, and the pressure roller may be an idler.

As the corner bead is reshaped, the legs of the bead move or splay downwardly and laterally. Thus, there is an obvious sideways scuffing action on the surface of the hemispherical rollers, particularly on the roller 27 which is directly under the roller 28. Thus, the idler rollers are made of filled Delrin™ acetal thermoplastic or other suitably durable material. The grooved roller 28 is preferably made of a durable metal. Other materials of construction for the tool may be utilized, depending on economics and the desired life of the product.

Referring again to FIGS. 2 and 3, the larger part of the downward load on the idler rollers will be borne by the roller 27, the rotational axis of which lies along a plumb line, or perfectly vertical line, running from the rotational axis of the pressure roller 28. The outer end idler rollers 29 (see FIG. 8), up and downstream of the pinch point or nip formed by the pressure roller, serve the dual purpose of (a) providing a bigger "footprint" for resisting downward force of the corner bead than would be the case if one idler roller 27 only was used; and, (b) guiding the direction of motion of the corner bead as it moves lengthwise through the tool during processing. In another embodiment, there is no idler roller 27 plumb beneath the pressure roller, and there are two spaced part idler rollers spaced apart along the corner bead travel path on either side of the plumb line. In this context, the term vertical with respect to the claimed invention should to be construed in the general sense and not the perfect sense.

Thus, in the generality of the preferred invention, the idler rollers function as means to vertically support the opposing legs of the corner bead as the apex of the bead is being pressed downward, while enabling the legs to splay or move laterally, and as a means for controlling the orientation of bead traveling within tool.

In use of tool 18, the vertical spacing of the pressure roller 28 is preset to a first position. The spacing is then adjusted according to angle which is achieved and or desired in a corner bead which is passed through the device. Obviously, a bead may be repetitively passed through the tool to accomplish a first and then a second degree of deformation. And, in a simplified embodiment of the invention, the spacing between the pressure roller and idler rollers can be fixed rather than adjustable. And, in another embodiment of the invention, the tool may have a first station, or stanchion and pressure roller, etc., which provides a first degree of deformation; and, spaced apart downstream, a second station providing a second degree of deformation. Of course, it is not likely that such product would be of much interest to sheet rock mechanics in the field, for whom portability and compactness is important,.

Figure 7:
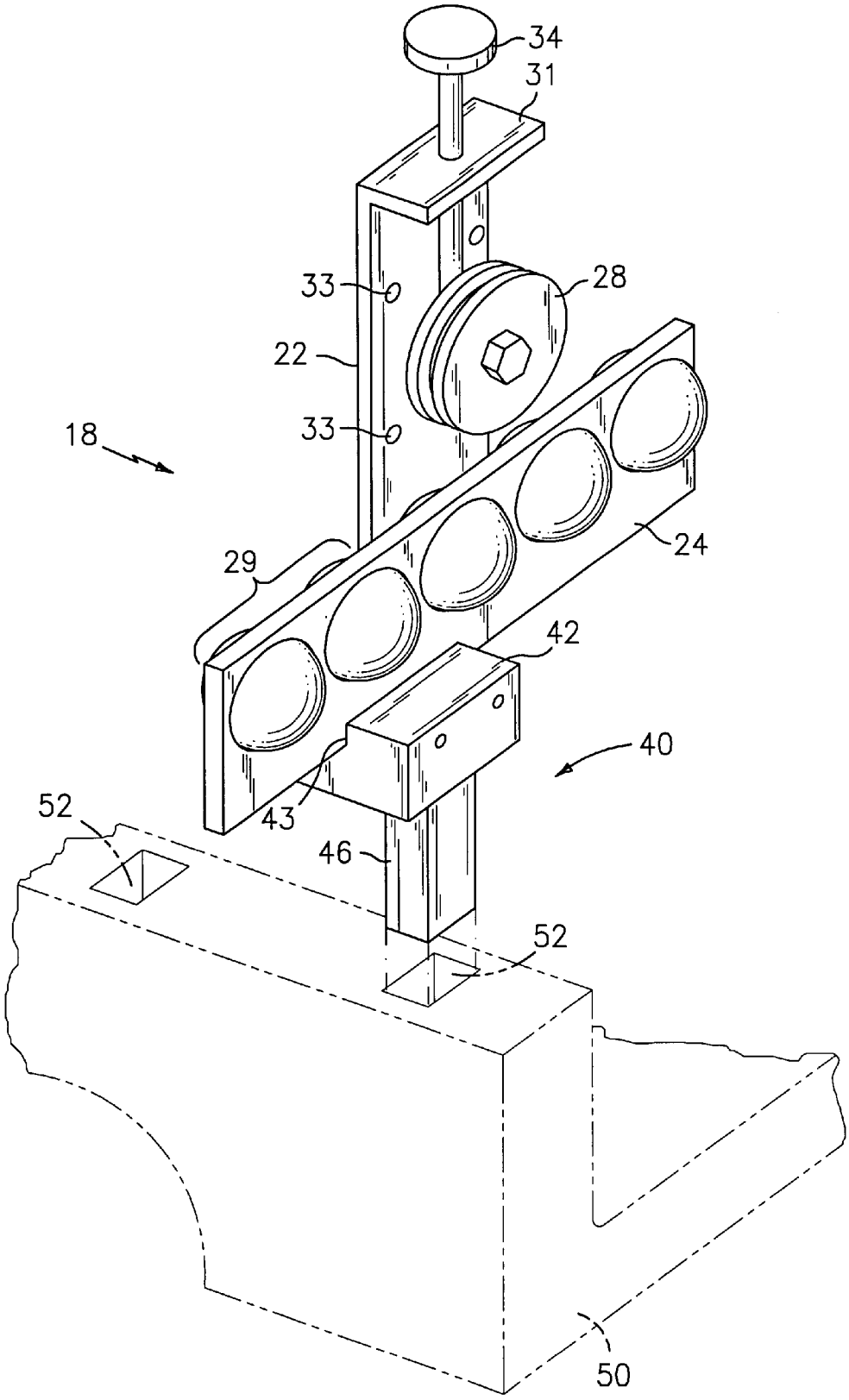
FIG. 7 is a perspective view of the tool shown in FIG. 2, attached to a mount or adapter which enables the tool to be inserted in the familiar stake hole of a pickup truck sidewall.

When in use, tool 18 ought to be clamped or permanently attached to a bench or other heavy object, so it does not move about. This is particularly the case if bead is being drawn through by pulling on the exit end of the bead, compared to when the pressure roller is driven. In one alternative, the stanchion of the fire has a multiplicity of holes 33, as shown in FIG. 7. Thus, tool 18 is temporarily screwed to a vertical post or other surface by the sheet rock mechanic. In another alternative, an accessory attachment plate having suitable holes for temporary fastening is attached to the frame.

Another convenient way to use the tool is to utilize the body of a pickup truck as a support. FIG. 7 illustrates one way in which such is accomplished. The tool 18 is first fastened to the top part 42 of a specially shaped mount 40 which is made of metal, plastic or wood. The top part 42 of the mount has a lengthwise slot 43 or other obvious means for receiving the rail 24, or some other part of the tool 18. The mount 40 has a downwardly extending tang 46 which is shaped to fit into one of the familiar post hole pockets 52 of a pickup truck body sidewall 50, shown in phantom. Clamps or screws to assist in the foregoing attachment of tool to mount are not detailed but obvious choices are present. Obviously, the mount may be made integral with the frame of the tool. That is, the frame may have a tang 46 extending downwardly.

Figure 11:
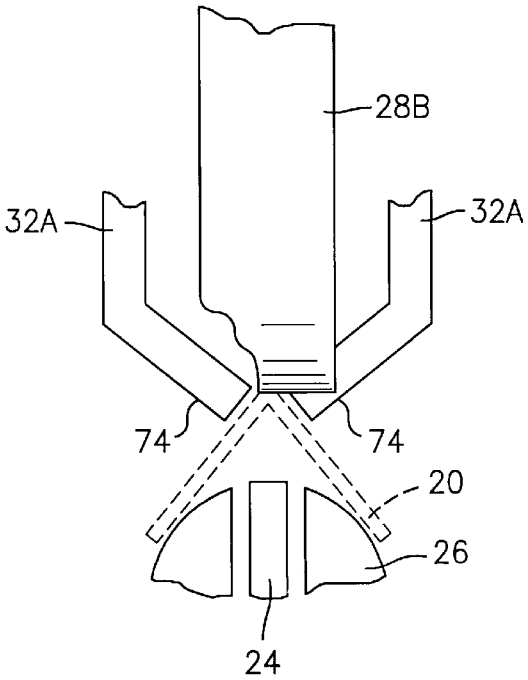
FIG. 11 is a view like FIG. 9, angled metal fingers which guide the location of the apex of a corner bead running along the idler rollers, when the pressure roller has no groove.
Figure 8:
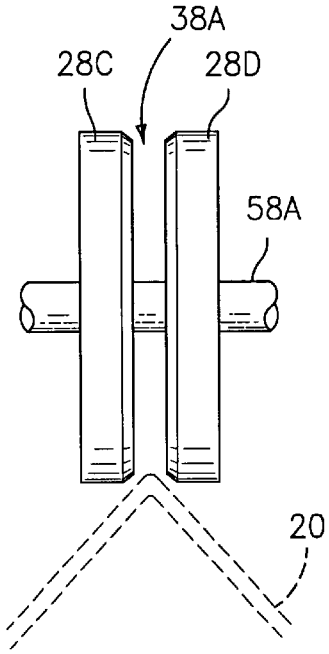
FIG. 8 shows an alternative embodiment of pressure roller comprising two spaced apart disks.

Other alternatives may be substituted for a grooved pressure roller, so long as there is a combination of vertical deforming force and means for controlling the lateral position of the apex, transverse to the travel direction and length of the corner bead. For instance, FIG. 8 shows two spaced apart rollers 28C, 28D mounted on a common shaft 58A. In another embodiment, the pressure roller 28B has no groove, and as shown in FIG. 11, fixed fingers 74 or other metal components are shaped to guide the apex and move cooperatively, or in coordination with, motion of the pressure roller. The fingers 74 extend from the slide block 32 or some other structure which moves up and down with the pressure roller, so they maintain their position with the apex as it is pushed downwardly. Multiple sets of fingers, up and downstream of the pressure roller are preferably used. Thus, in the generality of the invention, there is means for laterally controlling the location of the apex of the angle strip. Preferably, the means are integral with the pressure roller configuration, such as the aforementioned circumferential groove or the spaced apart dual rollers.

While the hemispherical pair configuration of idler rollers which has been described is preferred, other idler roller arrangements may be used within the scope of the invention. The following are suggestive of the generality of the invention. First, more or fewer rollers may be used. Second, instead of having a roller 27 directly beneath the pressure roller 28, two spaced apart roller may be used, one each displaced up and down stream from the point of contact of the pressure roller with the angle strip. Third, the opposing side pairs of hemisphere rollers may be staggered relative to each other. Fourth, the rail 24 shown in FIGS. 2, 3, for supporting the idler rollers may be replaced by other functionally equivalent structure, such as a plurality of uprights extending from the frame.

Figure 9:
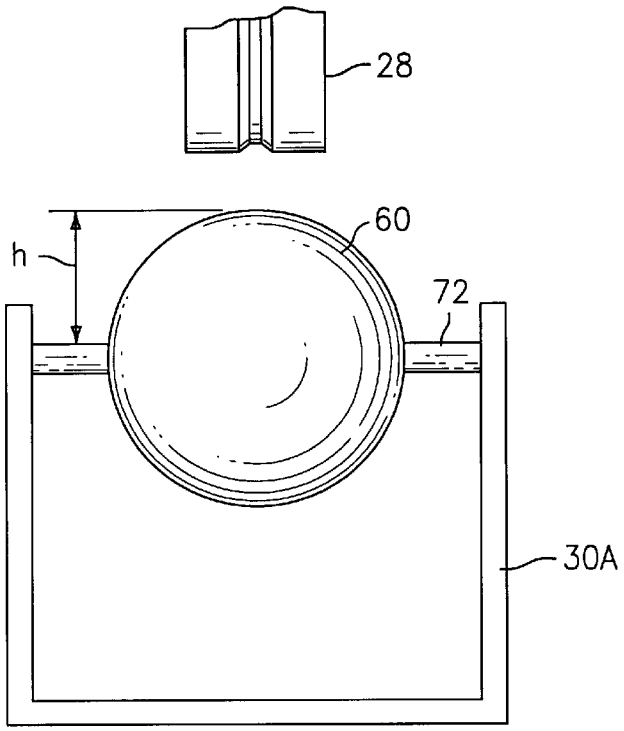
FIG. 9 shows an end elevation view of alternative embodiment of frame and idler rollers, namely hemispherical rollers.

FIG. 9 shows an alternate embodiment of frame and idler roller. A series of spherical rollers 60 are mounted within U-shape frame 30A. The dimension h has to be chosen to be sufficient to avoid having the maximum-splayed legs of the bead hit the shaft 72 when pressure roller 68 reshapes the corner bead.

Figure 10:
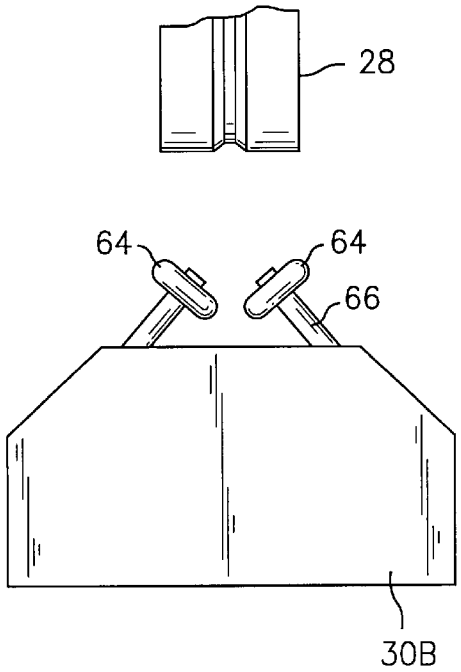
FIG. 10 is a view like FIG. 9, showing another embodiment of frame and idler rollers which comprises rollers on angled shafts.

FIG. 10 shows another frame and idler roller embodiment. Wheel like idler rollers 64 are mounted on angled stub shafts 66 which extend upward at angles to the vertical and to each other, from the frame 30B.

While spheres or segments of spheres are described above, and are preferred for simplicity of manufacture of idler rollers, it will be understood that other oblate shapes may be readily substituted for spheres or hemisphere. Thus, the term "sphere" (and variations of the root word) in the context of the claimed invention embraces shapes which are approximations to a sphere, and which carry out the same essential function While the invention was developed in the context of sheet metal mechanic needs, the invention may be applied to other situations in which any angle strip needs to be re-shaped or re-formed.

Although this invention has been shown and described with respect to a preferred embodiment, it will be understood by those skilled in this art that various changes in form and detail thereof may be made without departing from the spirit and scope of the claimed invention.

I claim:

1. A tool for reshaping corner bead used in wall board installation, to increase the included angle thereof, wherein the corner bead has an apex and opposing legs which form said included angle, and, wherein the corner bead travels through the tool along a generally horizontal travel path during reshaping; comprising:

a frame;

a plurality of spaced apart idler rollers rotatably mounted on the frame along the corner bead travel path, for supporting and guiding the direction of motion of the opposing legs of the corner bead during reshaping, each idler roller comprising a spherical section for enabling motion of the legs in a direction transverse to the direction of rotation of the roller during reshaping of the corner bead;

a vertical stanchion, extending upwardly from the frame;

a slide block, for supporting a pressure roller, mounted upon the stanchion, and adjustably movable there along;

a circumferentially grooved pressure roller rotatably mounted upon the stanchion, for pressing vertically downward on the apex of the corner bead while the legs of the corner bead are supported on said plurality of idler rollers; and, means, mounted on the stanchion and engaged with the slide block, for vertically adjusting the elevation of the slide block and the pressure roller mounted thereon, to vary the spacing between the pressure roller and the idler rollers.

2. The tool of claims 1, further comprising drive receptor means, attached to the pressure roller, the means adapted for engagement by a rotary driver, to enable rotation of the pressure roller by the driver.

3. The tool of claim 1, further comprising a vertically extending tang, attached to the frame, for enabling insertion of the tool into a post hole pocket of the sidewall of a pickup truck, so that the tool is held in place during use.

4. The tool of claim 3 wherein the tang is detachable from the frame.

5. A tool for reshaping corner bead used in wall board installation, to increase the included angle thereof, wherein the corner bead has an apex and opposing legs which form said included angle, and, wherein the corner bead travels through the tool along a generally horizontal travel path during reshaping; comprising:

a frame;

a plurality of spaced apart idler rollers rotatably mounted on the frame along the corner bead travel path, for supporting and guiding the direction of motion of the opposing legs of the corner bead during reshaping, each idler roller comprising a spherical section for enabling motion of the legs in a direction transverse to the direction of rotation of the roller during reshaping of the corner bead;

one vertically adjustable and circumferentially grooved pressure roller, rotatably mounted from the frame vertically above the corner bead travel path, for pressing on the apex of the corner bead while the legs of the corner bead are supported on the plurality of idler rollers; and, drive receptor means, attached to the pressure roller, the receptor means adapted for engagement by a rotary driver, to enable rotation of the pressure roller by said driver.

6. The tool of claims 5, further comprising drive receptor means, attached to the pressure roller, the means adapted for engagement by a rotary driver, to enable rotation of the pressure roller by the driver.

7. The tool of claim 5, further comprising a vertically extending tang, attached to the frame, for enabling insertion of the tool into a post hole pocket of the sidewall of a pickup truck, so that the tool is held in place during use.

8. The tool of claim 7 wherein the tang is detachable from the frame.

9. A tool for reshaping corner bead used in wall board installation, to increase the included angle thereof; wherein the corner bead has an apex and opposing legs which form said included angle; and, wherein the corner bead travels through the tool along a travel path during reshaping; comprising:

a frame, comprising a horizontal single rail part and a vertically extending stanchion part;

a plurality of spaced apart idler rollers, rotatably mounted along the length of the rail, for supporting the opposing legs of the corner bead during reshaping, said idler rollers aligned along and defining the corner bead travel path, said rollers enabling lateral motion of the legs in a direction transverse to the direction of rotation of the idler rollers and corner bead travel path when the corner bead is pressed downwardly onto the idler rollers by a pressure roller; wherein each of said idler rollers comprises a pair of hemispheric shaped half-rollers on opposing side of the rail; and, a vertically adjustable grooved pressure roller, rotatably mounted on said stanchion part vertically above said corner bead travel path, for pressing downwardly on the apex of a corner bead while the legs of the corner bead are supported on the idler rollers.

10. The tool of claim 9 where in the hemispheres are comprised of acetal thermoplastic.

11. The tool of claim 9, wherein a pair of the idler rollers are symmetrically positioned along the corner bead travel path on either side of the point at which the pressure roller is adapted to vertically press on a corner bead ling on the idler rollers.

12. The tool of claim 9, further comprising drive receptor means, attached to the pressure roller, the means adapted for engagement by a rotary driver, to enable rotation of the pressure roller by the driver.

13. The tool of claim 9, further comprising a vertically extending tang, attached to the frame, for enabling insertion of the tool into a post hole pocket of the sidewall of a pickup truck, so that the tool is held in place during use.

14. The tool of claim 7 wherein the tang is detachable from the frame.

15. A tool for reshaping corner bead used in wall board installation, to increase the included angle thereof; wherein the corner bead has an apex and opposing legs which form said included angle; and, wherein the corner bead travels through the tool along a travel path during reshaping; comprising:

a frame, comprising a horizontal single rail part and a vertically extending stanchion part;

a plurality of spaced apart idler rollers, rotatably mounted along the length of the rail, for supporting the opposing legs of the corner bead during reshaping, said idler rollers aligned along and defining the corner bead travel path, said rollers enabling lateral motion of the legs in a direction transverse to the direction of rotation of the idler rollers and corner bead travel path when the corner bead is pressed downwardly onto the idler rollers by a pressure roller; wherein each of said idler rollers comprises a pair of hemispheric shaped half-rollers on opposing side of the rail;

a slide block, for supporting a pressure roller, mounted upon the stanchion, and adjustably movable there along;

a circumferentially grooved pressure roller rotatably mounted upon the stanchion, for pressing vertically downward on the apex of the corner bead while the legs of the corner bead are supported on said plurality of idler rollers;

means, mounted on the stanchion and engaged with the slide block, for vertically adjusting the elevation of the slide block and the pressure roller mounted thereon, to vary the spacing between the pressure roller and the idler rollers; and, drive receptor means, attached to the pressure roller, the receptor means adapted for engagement by a rotary driver, to enable rotation of the pressure roller by said driver.

* * * * *